US008835374B2

(12) United States Patent
Guida et al.

(10) Patent No.: US 8,835,374 B2
(45) Date of Patent: Sep. 16, 2014

(54) PROCESS TO PREPARE AN EXTERNAL STRUCTURING SYSTEM FOR LIQUID LAUNDRY DETERGENT COMPOSITION

(71) Applicant: The Procter & Gamble Company, Cincinnati, OH (US)

(72) Inventors: Vincenzo Guida, Rome (IT); Joris Meert, Bambrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/964,132

(22) Filed: Aug. 12, 2013

(65) Prior Publication Data

US 2014/0094396 A1 Apr. 3, 2014

(30) Foreign Application Priority Data

Sep. 28, 2012 (EP) ..... 12186498

(51) Int. Cl.

| | |
|---|---|
| ***C11D 3/382*** | (2006.01) |
| ***C11D 3/30*** | (2006.01) |
| ***C11D 3/20*** | (2006.01) |
| ***C11D 3/04*** | (2006.01) |
| ***C11D 1/22*** | (2006.01) |
| ***C11D 17/00*** | (2006.01) |
| ***C11D 3/32*** | (2006.01) |

(52) U.S. Cl.

CPC ..... *C11D 17/0026* (2013.01); *C11D 3/30* (2013.01); *C11D 3/2044* (2013.01); *C11D 3/201* (2013.01); *C11D 3/2003* (2013.01); *C11D 3/2048* (2013.01); *C11D 3/2093* (2013.01); *C11D 3/044* (2013.01); *C11D 1/22* (2013.01); *C11D 3/2068* (2013.01); *C11D 3/323* (2013.01); *C11D 3/2017* (2013.01)

USPC ..... 510/296; 510/276; 510/280; 510/290; 510/303; 510/321; 510/336; 510/337; 510/342; 510/357; 510/365; 510/463

(58) Field of Classification Search

USPC ..... 510/276, 280, 290, 303, 321, 336, 337, 510/342, 357, 365, 463, 296

See application file for complete search history.

(56) References Cited

U.S. PATENT DOCUMENTS

| | | | | |
|---|---|---|---|---|
| 2,920,045 | A | 1/1960 | Hearn et al. | |
| 2004/0200005 | A1 | 10/2004 | Smerznak et al. | |
| 2006/0089294 | A1* | 4/2006 | Depoot et al. | 510/515 |
| 2011/0034366 | A1 | 2/2011 | Panandiker et al. | |
| 2011/0061174 | A1 | 3/2011 | Boutique et al. | |
| 2011/0065624 | A1 | 3/2011 | Boutique et al. | |
| 2011/0065625 | A1* | 3/2011 | Boutique et al. | 510/336 |

OTHER PUBLICATIONS

EP Search Report; 8 Pages; Dated Feb. 28, 2013.
U.S. Appl. No. 13/964,130, filed Aug. 12, 2013, Guida, et al.

* cited by examiner

*Primary Examiner* — Charles Boyer
(74) *Attorney, Agent, or Firm* — Gregory S. Darley-Emerson; Steven W. Miller

(57) ABSTRACT

The present invention relates to a process to prepare external structuring system(s) (ESS) comprising crystallized triglycerides including crystallized hydrogenated castor oil (HCO) and packing parameter adjusting agent to provide higher structuring ability. The present invention also relates to laundry detergent compositions in liquid or gel form comprising ESS.

16 Claims, 1 Drawing Sheet

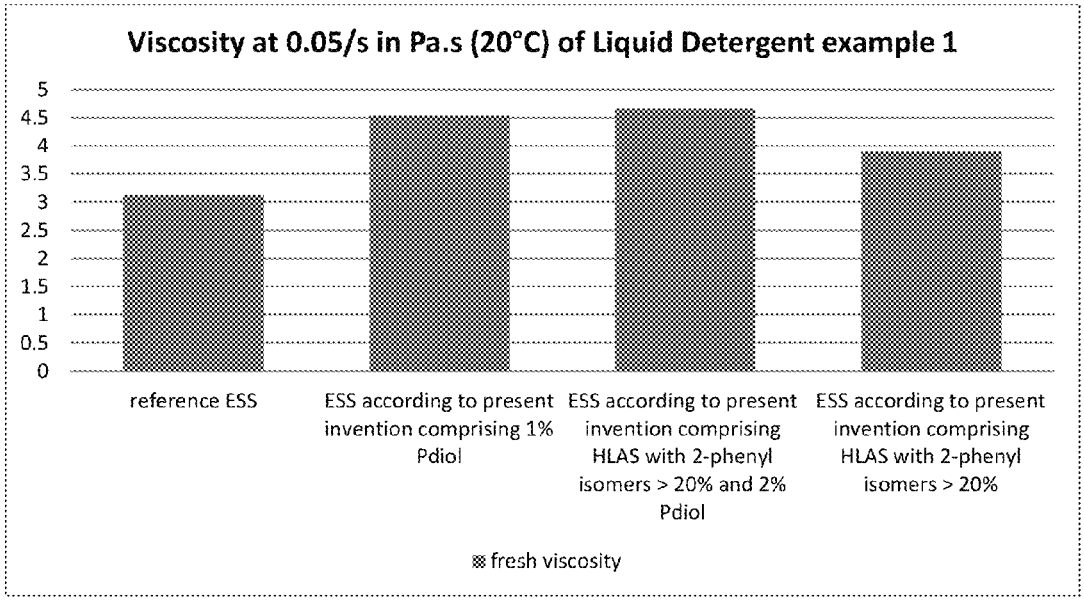
Viscosity at 0.05/s in Pa.s (20°C) of Liquid Detergent example 1
5
4.5
4
3.5
3
2.5
2
1.5
1
0.5
0
reference ESS
ESS according to present invention comprising 1% Pdiol
ESS according to present invention comprising HLAS with 2-phenyl isomers > 20% and 2% Pdiol
ESS according to present invention comprising HLAS with 2-phenyl isomers > 20%
fresh viscosity

PROCESS TO PREPARE AN EXTERNAL STRUCTURING SYSTEM FOR LIQUID LAUNDRY DETERGENT COMPOSITION

FIELD OF THE INVENTION

The present invention relates to a process to prepare external structuring system(s) (ESS) comprising crystallized triglycerides including crystallized hydrogenated castor oil (HCO) and packing parameter adjusting agent to provide higher structuring ability. The present invention also relates to laundry detergent compositions in liquid or gel form comprising ESS.

BACKGROUND OF THE INVENTION

Liquid compositions, particularly aqueous detergent compositions comprising appreciable amounts of surfactants may be difficult to formulate, given their tendency to split into two or more phases, such as one or more surfactant-rich phases and a water-rich phase. Further technical difficulties may arise when particulate matter is to be suspended in surfactant-containing liquid compositions as the particulates may have a tendency to rise to the top or to settle to the bottom of the composition over time. Yet consumers delight in fluid detergents offering stabilized particulate materials which can deliver cleaning performance, fabric care benefits, appearance benefits, and/or visual or aesthetic cues. Crystallizable glycerides including hydrogenated castor oil (HCO, Thixcin R®, castor wax, trihydroxystearin) has been used as a rheology-modifying agent or external structurant for many years. When crystallized to fiber/thread—like crystals, HCO can stabilize liquid compositions and prevent separation from the liquid phase or prevent coagulation of liquid crystals or suspended particles.

Aqueous laundry detergent compositions which are stabilized through the use of external structuring system(s) (ESS) comprising hydroxyl-containing stabilizers have been described in the past. The ESS is added to the detergent composition to obtain desired finished product rheology and structuring. However, ESS(s) always contain relatively high quantities of water, and therefore, this feature may be undesired in the final product, especially when ESS is added into the laundry detergent compositions which requires low water quantites. Therefore, there is need for improve ESS to provide effective structuring properties.

It is thus an object of the present invention to provide process to prepare an ESSs suitable for detergent compositions to provide improved structuring ability.

It has now been discovered that the above mentioned objective can be met by using combination of crystallizable glyceride(s), anionic surfactant and packing parameter adjusting agent in the ESS.

SUMMARY OF THE INVENTION

The present invention relates to a process of preparing an external structuring system for liquid and gel-form detergents comprising steps of: i) preparing a premix by adding 5% to 50% by weight of the external structuring system of an anionic surfactant or a mixture thereof into water and mixing; ii) neutralising premix of step i) to pH 7.0-7.6 by adding pH adjusting agent or a mixture thereof at temperature between 87° C. and 95° C. and mixing; iii) adding 2% to 10% by weight of the external structuring system of crystals of a glyceride or a mixture thereof having melting point of from 40° C. to 100° C. and mixing; iv) emulsification by mixing of the premixture of steps i)-iii); v) cooling the emulsification of step iv) down to a temperature between 25° C. and 45° C. under controlled cooling rate of 1-2° C./min; characterized in that from 0.5% to 3.0% by weight of the external structuring system of packing parameter adjusting agent or a mixture thereof is added into said premix prior to said crystals of a glyceride start to crystallize.

The present invention further encompasses a use of the external structuring system according to present invention in a detergent composition to reduce shear sensitivity.

BRIEF DESCRIPTION OF THE DRAWINGS

FIG. 1 shows the viscosity for the reference ESS and three different ESS compositions according to the present invention at 20° C. at shear rate 0.05/s.

DETAILED DESCRIPTION OF THE INVENTION

As used herein, the term "external structuring system" or ESS refers to a selected compound or mixture of compounds which provide structure to a detergent composition independently from, or extrinsic from, any structuring effect of the detersive surfactants of the composition. Structuring benefits include arriving at yield stresses suitable for suspending particles having a wide range of sizes and densities. ESS of use may have chemical identities set out in detail hereinafter.

Without wishing to be bound by theory, many external structurants are believed to operate by forming solid structures having particular morphologies in the detergent composition. These solid structures may take one or more physical forms. Non-limiting examples of typical physical or morphological forms include threads, needles, ribbons, rosettes and mixtures thereof. Without wishing to be bound by theory, it is believed that thread-like, ribbon-like, spindle-like or fibril-like structuring systems, that is to say structuring systems having non-spherical elongated particles, provide the most efficient structure in liquids. Consequently, in some embodiments, thread-like, ribbon-like, spindle-like or fibril-like structuring systems are preferred. It is further believed that external structurant systems comprising crystallizable glyceridenes including CHO and packing parameter adjusting agent may contain, and provide both in ESS and in detergent compositions, a more complete and shear resistance fiber network than is present in an otherwise analogous composition but without this combination. Without wishing to be bound by theory it is believed that fibers irreversible aggregation under flow is contrasted by electrostatic repulsion forces due electrical charges deposited on the fiber surface by the specific surfactant. Furthermore, when packing parameter adjusting agent is added the electrostatic forces are perceived stronger at higher distance, thus preventing better from aggregation under shear.

"Liquid" as used herein may include liquids, gels, foams, mousse, and any other flowable substantially non-gas phased composition. Non-limiting examples of fluids within the scope of this invention include light duty and heavy duty liquid detergent compositions, hard surface cleaning compositions, detergent gels commonly used for laundry, and bleach and laundry additives. Gases, e.g., suspended bubbles, may be included within the liquids.

By "internal structuring" it is meant that the detergent surfactants, which form a major class of laundering ingredients, are relied on for structuring effect. The present invention, in the opposite sense, aims at "external structuring" meaning structuring which relies on a nonsurfactant, e.g., crystallized glyceride(s) including, but not limited to, hydrogenated castor oil, to achieve the desired rheology and particle suspending power.

"Limited solubility" as used herein means that no more than nine tenths of the formulated agent actually dissolves in the liquid composition. An advantage of crystallizable glyceride(s) such as hydrogenated castor oil as an external structurant is an extremely limited water solubility.

"Soluble" as used herein means that more than nine tenths of the formulated agent actually dissolves in the liquid composition at a temperature of 20° C.

ESS of the present invention is so called premix. "Premix" as used herein means a mixture of ingredients designed to be mixed with other ingredients, such as the balance of a liquid or gel-form laundry detergent, before marketing. A "premix" can itself be an article of commerce, and can be sold, for example in bulk containers, for later mixing with the balance of a laundry detergent at a remote location. One the other hand some premixes may directly be used for arriving at a complete detergent composition made in a single facility.

"Emulsion" as used herein, unless otherwise specifically indicated, refers to macroscopic droplets, which are large enough to be seen using conventional optical microscopy, of hydrogenated castor oil and/or another triglyceride, in the structurant premix (ESS). The emulsion can involve liquid droplets or can involve solidified droplets, depending on the temperature. Hydrogenated castor oil is soluble to a limited extent in the alkanolamine neutralized anionic surfactant containing premix, and as a result, microemulsions may also be present.

"Aspect ratio" as defined herein means the ratio of the largest dimension of a particle (l) to the smallest dimension of a particle (w), expressed as "l:w". An aspect ratio may for example characterize a structurant crystal particle of crystallizable glyceride(s) such as hydrogenated castor oil. The aspect ratio of dispersions can be adequately characterized by TEM (transmission electron microscopy) or similar techniques, e.g., cryo-ESEM. In using such techniques in the present invention, the intent is to examine crystals of the hydrogenated castor oil, or, more generally, any equivalently crystallizable glyceride; hence, it is preferred to conduct measurements with a minimum of artifact creation. Artifacts can be created, for example, by evaporating solvent from the ESS so that surfactant crystals precipitate—these are not crystals of glyceride(s) such as hydrogenated castor oil for example. A high aspect ratio is desirable for the hydrogenated castor oil in the external structurants for use herein. Preferably the aspect ratio of crystals of hydrogenated castor oil in ESS and/or in detergents comprising is greater than 1:1, in other words the structurant crystals are elongated. In a preferred embodiment, the aspect ratio is at least 5:1. In a preferred embodiment the aspect ratio is from 5:1 to about 200:1, preferably from about 10:1 to about 100:1. In typical cases, the aspect ratio can be from 10:1 to 50:1. Aggregation or breakage of the crystals reduces the aspect ratio, is not preferred.

"Rosette" as defined herein means a particle of crystallized structurant, e.g., of a crystals of glyceride such as hydrogenated castor oil for example, having a rosette-like appearance. Such particles can be readily seen by use of differential interference contrast microscopy, or other visual microscopy techniques. Rosettes can have an approximate diameter of 1-50 microns, more typically 2 to 20 microns, e.g., about 5 microns. Preferred ESS herein can be free from rosettes. Other preferred ESS herein may have a low proportion of rosettes to needle-like crystals. Without intending to be limited by theory, reducing the proportion of rosettes to needles improves the mass efficiency of the ESS.

All percentages, ratios and proportions used herein are by weight percent of the composition, unless otherwise specified. All average values are calculated "by weight" of the composition or components thereof, unless otherwise expressly indicated.

Process of Preparing External Structuring System

ESS according to present invention can be prepared by using a process comprising steps of:

i) Preparing a premix by adding 5% to 50% by weight of the external structuring system of an anionic surfactant or a mixture thereof into water and mixing;

ii) Neutralising premix of step i) to pH 7.0 to 7.6 by adding pH adjusting agent or a mixture thereof at temperature between 87° C. and 95° C. and mixing;

iii) Adding 2% to 10% by weight of the external structuring system of crystals of a glyceride or a mixture thereof having melting point of from 40° C. to 100° C. and mixing;

iv) Emulsification by mixing of the premixture of steps i)-iii);

v) Cooling the emulsification of step iv) down to a temperature between 25 and 45° C. under controlled cooling rate of 1-2° C./min;

characterized in that from 0.5% to 3.0% by weight of the external structuring system of packing parameter adjusting agent or a mixture thereof is added into said premix prior to said crystals of a glyceride start to crystallize.

Each of the steps and the ingredients are discussed below.

i) Preparing a Premix

In this step, a premix is made. The premix comprises water and an anionic surfactant or a mixture thereof. The anionic surfactant is added to the water of the ESS and mixed (at 90° C. gentle mixing for 5 minutes). Preferably demineralised water is used. Surfactant solution will selfassemble in a way depending on its packing parameter, which is influenced by concentration of the surfactant in a solution; the surfactant head group size and charge; the surfactant carbon chain length and branching; and the surfactant counter ion. Packing parameter value of 0.5 is preferred, as this promotes formation elongated micelles. Packing parameter is defined in details 12. Israelachvili, J N, *Intermolecular and surface forces*. 2nd ed. Academic Press (London; San Diego) (1992), xxi, 450. If the packing parameter is below 0.5, less and shorter elongated micelles will be formed, whereas, if the packing parameter is below 0.3, only spherical micelles are formed. On the other hand, if the packing parameter value is above 0.5, more lamellar phase will be formed, usually in the form of vehicles. Therefore, depending on the packing parameter the surfactant exists as free surfactant, micelled surfactant, elongated (worm like) micelles, lamellar phase (vesicles or sheets) or hexaconal phase. Preferred surfactant form is elongated micelles.

ii) Neutralizing the Premix of Step i)

In this step pH adjusting agent or a mixture thereof is added to set the pH from 7.0 to 7.6 at the temperature between 87° C. and 95° C. and mixing. The pH mentioned is the neat pH at the process temperature mentioned. Generally 2%-10% by weight of ESS of pH adjusting agent is used to neutralise the premix of step i). It is desired to have pH neutral ESS. Neutral pH has positive impact on packing parameter. Furthermore, pH neutral ESS is easier to add into final product as no neutralising step is then required.

iii) Adding the Crystals of a Glyceride into the Premix

In this step the crystals of a glyceride or a mixture thereof having a melting point of from 40° C. to 100° C. are added into the premix and mixture is mixed. Slightly turbulent mixing is required to ensure that the glyceride solids are drawn into the mixture.

iv) Emulsification of the Crystallizable Glyceride(s)

In this step, the crystallizable glyceride(s) in the premix is emulsified, forming an emulsion, a mixture of an emulsion and a microemulsion, or a microemulsion by mixing the premix with medium to high agitator speed. Emulsification may be also accomplished by increasing the temperature of the premix and/or by energy dissipation through the premix.

The temperature may be increased using heat of neutralization of the anionic surfactant acid form on mixing with the pH adjusting agent; and/or through the application of heat from an external source.

The premix is heated to a temperature above room temperature. In some embodiments, the premix is heated to above the melting point of the crystallizable glyceride, such as HCO for example. In some embodiments, the premix is heated to a temperature of from 50° C. to 150° C., or from 75° C. to 125° C., or from 80° C. to 95° C.

With energy dissipation, it is understood that any kind of device, delivering energy input to the premix can be applied to form the emulsion. Non-limiting examples of such devices may be selected from: static mixers and dynamic mixers (including all kinds of low shear and high shear mixers). In some embodiments, the emulsion can be formed in batch making system or in a semi continuous making system or a continuous making system.

v) Cooling the Premix

In this step, the premix is then cooled. Without wishing to be bound by theory, it is believed that during cooling, the liquid oil emulsion droplets de-wet as a result of surfactant adsorption, thereby promoting crystallization. Small crystals may nucleate from around the emulsion droplets during cooling. It is further believed that crystallization may be influenced by surfactant adsorption and/or cooling rate.

Preferably the external structuring system is cooled at a cooling rate of from 1° C./min to 2° C./min Addition of Packing Parameter Adjusting Agent In this step packing parameter adjusting agent is added into said premix prior said crystals of a glyceride start to crystallize. The packing parameter adjusting agent in the solution effects on surfactant packing due its ability to increase the solubility of the surfactant into the water and this affects on the surfactant phase behaviour. Preferably the packing parameter adjusting agent is added at the latest, when the temperature of the premix is above 75° C. It has been found that when packing parameter adjusting agent is added into and blended with the mixture prior the crystallisation of crystals of a glyceride, surfactant premix favors elongated micelles formation. Indeed, it has been found that optimal quantity of packing parameter adjusting agent converts the vesicled into elongated micelles and therefore improves ESS quality. Additionally it has been found that, at a later stage, the addition of a packing parameter adjusting agent improves the dispersability of the ESS when added to the finished product.

External Structuring System

The ESS of the present invention comprise: (a) crystallizable glyceride(s); (b) pH adjusting agent or mixture thereof; (c) anionic surfactant or mixture thereof; (d) packing parameter adjusting agent or mixture thereof (e) additional components; and (f) optional components. Each of these components is discussed in detail below.

(a) Crystallizable Glyceride(s)

Crystallizable glyceride(s) of use herein include "Hydrogenated castor oil" or "HCO" and is an essential component the ESS of the present invention. HCO as used herein most generally can be any hydrogenated castor oil, provided that it is capable of crystallizing in the ESS premix. Castor oils may include glycerides, especially triglycerides, comprising $C_{10}$ to $C_{22}$ alkyl or alkenyl moieties which incorporate a hydroxyl group. Hydrogenation of castor oil to make HCO converts double bonds, which may be present in the starting oil as ricinoleyl moieties, to convert ricinoleyl moieties to saturated hydroxyalkyl moieties, e.g., hydroxystearyl. The HCO herein may, in some embodiments, be selected from: trihydroxystearin; dihydroxystearin; and mixtures thereof. The HCO may be processed in any suitable starting form, including, but not limited those selected from solid, molten and mixtures thereof. HCO is typically present in the ESS of the present invention at a level of from 2% to 10%, from 3% to 8%, or from 4% to 6% by weight of the ESS. In some embodiments, the corresponding percentage of hydrogenated castor oil delivered into a finished laundry detergent product is below 1.0%, typically from 0.1% to 0.8%.

Useful HCO may have the following characteristics: a melting point of from 40° C. to 100° C., preferably from 65° C. to 95° C.; and/or Iodine value ranges of from 0 to 5, preferably from 0 to 4, and most preferably from 0 to 2.6. The melting point of HCO can measured using either ASTM D3418 or ISO 11357; both tests utilize DSC: Differential Scanning calorimetry.

HCO of use in the present invention includes those that are commercially available. Non-limiting examples of commercially available HCO of use in the present invention include: THIXCIN® from Rheox, Inc. Further examples of useful HCO may be found in U.S. Pat. No. 5,340,390. The source of the castor oil for hydrogenation to form HCO can be of any suitable origin, such as from Brazil or India. In one suitable embodiment, castor oil is hydrogenated using a precious metal, e.g., palladium catalyst, and the hydrogenation temperature and pressure are controlled to optimize hydrogenation of the double bonds of the native castor oil while avoiding unacceptable levels of dehydroxylation.

The invention is not intended to be directed only to the use of hydrogenated castor oil. Any other suitable crystallizable glyceride(s) may be used. In one example, the structurant is substantially pure triglyceride of 12-hydroxystearic acid. This molecule represents the pure form of a fully hydrogenated triglyceride of 12-hydroxy-9-cis-octadecenoic acid. In nature, the composition of castor oil is rather constant, but may vary somewhat. Likewise hydrogenation procedures may vary. Any other suitable equivalent materials, such as mixtures of triglycerides wherein at least 80% wt. is from castor oil, may be used. Exemplary equivalent materials comprise primarily, or consist essentially of, triglycerides; or comprise primarily, or consist essentially of, mixtures of diglycerides and triglycerides; or comprise primarily, or consist essentially of, mixtures of triglycerides with diglycerides and limited amounts, e.g., less than about 20% wt. of the glyceride mixtures, of monoglycerides; or comprise primarily, or consist essentially of, any of the foregoing glycerides with limited amounts, e.g., less than about 20% wt., of the corresponding acid hydrolysis product of any of said glycerides. A proviso in the above is that the major proportion, typically at least 80% wt, of any of said glycerides is chemically identical to glyceride of fully hydrogenated ricinoleic acid, i.e., glyceride of 12-hydroxystearic acid. It is for example well known in the art to modify hydrogenated castor oil such that in a given triglyceride, there will be two 12-hydroxystearic-moieties and one stearic moiety. Likewise it is envisioned that the hydrogenated castor oil may not be fully hydrogenated. In contrast, the invention excludes poly(oxyalkylated) castor oils when these fail the melting criteria.

(b) pH Adjusting Agent pH adjusting agent is an essential component the ESS of the present invention. Compositions of the present invention comprise one or more pH-adjusting agents. The pH-adjusting agent is typically present at concentrations from 2% to 20%, preferably from 22% to 10%, more preferably from 0.3% to 5.0% by weight of the structuring system.

In general any known pH-adjusting agents are useful herein, including alkalinity sources as well as acidifying agents of either inorganic type and organic type.

Inorganic alkalinity sources include but are not limited to, water-soluble alkali metal hydroxides, oxides, carbonates, bicarbonates, borates, silicates, metasilicates, and mixtures thereof; water-soluble alkali earth metal hydroxides, oxides, carbonates, bicarbonates, borates, silicates, metasilicates, and mixtures thereof; water-soluble boron group metal hydroxides, oxides, carbonates, bicarbonates, borates, silicates, metasilicates, and mixtures thereof; and mixtures thereof. Preferred inorganic alkalinity sources are sodium hydroxide, and potassium hydroxide and mixtures thereof, most preferably inorganic alkalinity source is sodium hydroxide. Although not preferred for ecological reasons, water-soluble phosphate salts may be utilized as alkalinity sources, including pyrophosphates, orthophosphates, polyphosphates, phosphonates, and mixtures thereof.

Organic alkalinity sources include but are not limited to, primary, secondary, tertiary amines, and mixtures thereof.

Other organic alkalinity sources are alkanolamine or mixture of alkanolamines. Suitable alkanolamines may be selected from the lower alkanol mono-, di-, and trialkanolamines, such as monoethanolamine; diethanolamine or triethanolamine. Higher alkanolamines have higher molecular weight and may be less mass efficient for the present purposes. Mono- and di-alkanolamines are preferred for mass efficiency reasons. Monoethanolamine is particularly preferred, however an additional alkanolamine, such as triethanolamine, can be useful in certain embodiments as a buffer. Most preferred alkanolamine used herein is monoethanol amine.

Inorganic acidifying agents include but are not limited to, HF, HCl, HBr, HI, boric acid, phosphoric acid, phosphonic acid, sulphuric acid, sulphonic acid, and mixtures thereof. Preferred inorganic acidifying agent is boric acid.

Organic acidifying agents include but are not limited to, substituted and substituted, branched, linear and/or cyclic $C_1$ to $C_{30}$ carboxyl acids, and mixtures thereof.

(c) Anionic Surfactant

Anionic surfactant is an essential component the ESS of the present invention. Without wishing to be bound by theory, it is believed that the anionic surfactant acts as an emulsifier of melts of HCO and similarly crystallizable glycerides. In the context of the external structuring system only (as opposed to in the context of a liquid detergent composition comprising a surfactant system), the following is true. As used herein "anionic surfactant" in preferred embodiments does not include soaps and fatty acids; they may be present in the final laundry detergent compositions, but in general, other than limited amounts of 12-hydroxystearic acid which may arise from limited hydrolysis of hydrogenated castor oil glycerides, are not deliberately included in the ESS. For overall formula accounting purposes, "soaps" and "fatty acids" are accounted as builders. Otherwise, any suitable anionic surfactant is of use in the ESS of present invention.

Suitable anionic surfactants for use herein can comprise any of the conventional anionic surfactant types typically used in liquid products. These include the alkyl sulfonic acids, alkyl benzene sulfonic acids, ethoxylated alkyl sulfates and their salts as well as alkoxylated or un-alkoxylated alkyl sulfate materials.

Non-limiting examples of suitable anionic surfactants of use herein include: Linear Alkyl Benzene Sulphonate (LAS), Alkyl Sulphates (AS), Alkyl Ethoxylated Sulphonates (AES), Laureth Sulfates and mixtures thereof, most preferred anionic surfactant is liner alkyl benzene sulphonate (LAS). The anionic surfactant may be present in the external structuring system at a level of from 5% to 50%. However, when using more than 25% by weight of the ESS of an anionic surfactant, it is typically required to thin the surfactant using an organic solvent in addition to water.

Preferred anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Preferred are the sodium and potassium linear alkylbenzene sulfonates in which the average number of carbon atoms in the alkyl group is from about 11 to 14. Most preferred are the acidic form of linear alkylbenzene sulfonates (HLAS) in which the average number of carbon atoms in the alkyl group is from about 11 to 14. $C_{11}$-$C_{14}$, e.g., $C_{12}$ HLAS is most preferred.

The HLAS surfactant tail length (length of the longest carbon chain) has great impact to the packing parameter. The longer the HLAS surfactant tail length, the more vesicle conversion into wormlike micelles is promoted (excellent for forming high aspect ratio crystals upon crystallization) which improves ESS structuring quality. Hence, the isomeration of HLAS is the key factor, however, the total length of the carbon chain has also impact. Isomeration depends on where the benzene ring is attached to the carbon chain and the total length of the carbon chain. The commercial HLAS consists of mixture of different HLAS isomers, some of them chemical structures are exemplified below. Most preferred HLAS isomer is 2-phenyl isomer. Most preferably HLAS comprises at least 20% by weight of HLAS of 2-phenyl isomer to maximize the surfactant packing parameter to 0.5. below are illustrated general structure of some of the HLAS isomers.

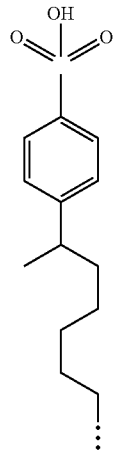

2-phenyl

-continued

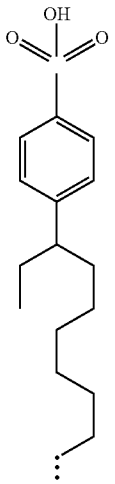

3-phenyl

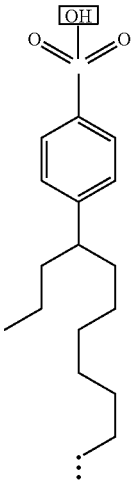

4-phenyl

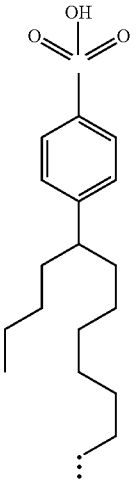

5-phenyl

-continued

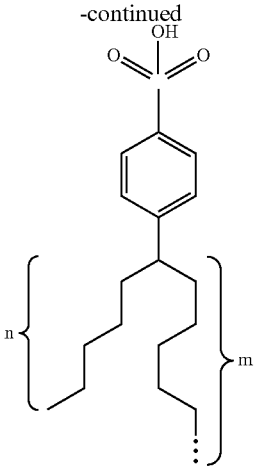

6-phenyl (d) Packing Parameter Adjusting Agent

Packing parameter adjusting agent is essential component of ESS of the present invention. Packing parameter adjusting agent will promote optimal dispersibility of ESS. Packing parameter adjusting agent increase the solubility of the surfactant into water in which in turn will have effect on the surfactant phase behaviour. Depending on the packing parameter adjusting agent level the effect can be in both directions. A low level of packing parameter adjusting agent (<3% by weight of ESS) promotes vesicle conversion into wormlike micelles (excellent for forming high aspect ratio crystals upon crystallization) and improves ESS structuring quality. When higher levels of packing parameter adjusting agent are used (>4% by weight of ESS) the micelles will become shorter resulting in less high aspect ratio crystals reducing ESS structuring ability.

Thus packing parameter adjusting agent are present when preparing the ESS. Preferred packing parameter adjusting agents include monohydric alcohols, dihydric alcohols, polyhydric alcohols, glycerol, glycols, urea and mixtures thereof. Suitable alcohols especially include a C1-C4 alcohols. Highly preferred are mixtures of solvents, especially mixtures of lower aliphatic alcohols such as ethanol, propanol, butanol, isopropanol, and/or diols such as 1,2-propanediol or 1,3-propanediol; diethylene glycol and mixtures thereof. Preferably packing parameter adjusting agent is 1,2-propanediol, 1,3-propanediol or urea, most preferably the packing parameter adjusting agent is 1,2-propanediol. In the ESS, packing parameter adjusting agent is present at levels from 0.5% to 3.0% by weight of the ESS, preferably from 0.75% to 2.25% and most preferably from greater than 0.75% to equal or less than 2% by weight of the ESS.

(e) Additional Components

Additional Surfactant

The ESS of the present invention may optionally contain surfactant in addition to anionic surfactants. In some embodiments, the systems may further comprise surfactant selected from: nonionic surfactant; cationic surfactant; amphoteric surfactant; zwitterionic surfactant; and mixtures thereof.

Buffer

The ESS of the invention may optionally contain a pH buffer. Without wishing to be bound by theory, it is believed that the buffer stabilizes the pH of the ESS thereby limiting any potential hydrolysis of the HCO structurant. However, buffer-free embodiments can be contemplated and when HCO hydrolyses, some 12-hydroxystearate may be formed, which has been described in the art as being capable of structuring. In certain preferred buffer-containing embodiments, the pH buffer does not introduce monovalent inorganic cations, such as sodium, in the structuring system. In some embodiments, the preferred buffer is the monethanolamine salt of boric acid. However embodiments are also contemplated in which the buffer is sodium-free and boron-free; or is free from any deliberately added sodium, boron or phosphorus. In some embodiments, the MEA neutralized boric acid may be present at a level of from 0% to 5%, from 0.5% to 3%, or from 0.75% to 1% by weight of the structuring system.

As already noted, alkanolamines such as triethanolamine and/or other amines can be used as buffers; provided that alkanolamine is first provided in an amount sufficient for the primary structurant emulsifying purpose of neutralizing the acid form of anionic surfactants.

Water

ESS of the present invention may contain water. Water may form the balance of the present structuring systems after the weight percentage of all of the other ingredients are taken into account.

In some embodiments, the water may be present at a level of from 5% to 90% by weight of the external structuring system, preferably from 10% to 80%, more preferably from 15% to 78% and most preferably from 30% to 78%.

(f) Optional Components

Preservative

Preservatives such as soluble preservatives may be added to the ESS or to the final detergent product so as to limit contamination by microorganisms. Such contamination can lead to colonies of bacteria and fungi capable of resulting in phase separation, unpleasant, e.g., rancid odors and the like. The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

Typically, preservatives will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between 0.00001% and 0.5% of the total formula, based on weight. Obviously, however, the effective level will vary based on the material used, and one skilled in the art should be able to select an appropriate preservative and use level.

Preferred preservatives for the compositions of this invention include organic sulphur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of 77% 5-chloro-2-methyl-4-isothiazolin-3-one and 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel™ GXL sold by Arch Chemicals (Atlanta, Ga.); and a 95:5 mixture of 1,3 bis(hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.). A highly preferred preservative system is sold commercially as Acticide™ MBS and comprises the actives methyl-4-isothiazoline (MIT) and 1,2-benzisothizolin-3-one (BIT) in approximately equal proportions by weight and at a total concentration in the Acticide™ MBS of 5%. The Acticide is formulated at levels of 0.001 to 0.1%, more typically 0.01 to 0.1% by weight on a 100% active basis in the ESS premix.

Other Thickeners

Polymeric thickeners known in the art, e.g., Carbopol™ from Lubrizol (Wickliffe, Ohio), acrylate copolymers such as those known as associative thickeners and the like may be used to supplement the ESS. These materials may be added either in the ESS premix, or separately into the final detergent composition. Additionally or alternatively known LMOG (low molecular weight organogellants) such as dibenzylidene sorbitol may be added to the compositions either in the ESS premix, or in the final detergent compositions. Suitable use levels are from 0.01% to 5%, or from 0.1 to 1% by weight of the final detergent composition.

Particulate Material

Either the ESS or the final detergent composition may further include particulate material such as suds suppressors, encapsulated sensitive ingredients, e.g., perfumes, bleaches and enzymes in encapsulated form; or aesthetic adjuncts such as pearlescent agents, pigment particles, mica or the like. Suitable use levels are from 0.0001% to 5%, or from 0.1% to 1% by weight of the final detergent composition. In embodiments of the invention it is found useful to incorporate certain particulate materials, e.g., mica for visual appearance benefits, directly into the ESS while formulating more sensitive particulate materials, e.g., encapsulated enzymes and/or bleaches, at a later point into the final detergent composition.

General Shear Conditions

As has already been pointed out, the ESS herein can be manufactured using a range of equipment types and shear regimes. In one preferred embodiment, the process employs a relatively low shear regime, in which shear rates reach a maximum of from 100 to 500 $s^{-1}$, and the ESS experiences this shear maximum for a residence time under the highest shear condition of no more than 60 to 100 seconds (s). In practical terms, one process employs batch, pipe, pump and plate heat exchanger devices, and the maximum shear occurs in the plate heat exchanger stage used to cool the ESS; but the ESS passes quite seldom through this high shear area, for example only from about three to about five passes per production run.

Detergent Compositions

The ESS of the present invention may be incorporated into a detergent composition or components thereof as described below. The detergent composition can take any suitable form and may be selected from liquid laundry detergent, unit dose detergent and/or hard surface cleaning compositions.

Method of Incorporating the External Structuring System

Any suitable means of incorporating the ESS of the present invention into a detergent composition or components thereof may be utilized. One of skill in the art is capable of determining at what point in the detergent manufacturing process that the ESS should be incorporated. Since ESS of the present invention may be shear sensitive, it may be desirable in some embodiments to add the ESS to the detergent composition or components of thereof as late in the manufacturing process as possible. However, in some embodiments, it may be desirable to add the ESS earlier in the manufacturing process to stabilize any non-homogeneity prior to finishing the detergent in a late product differentiation process. Thus in some embodiments, the systems may be added via a continuous liquid process, whereas in other embodiments, the systems may be added via late product differentiation.

When incorporating ESS that are shear sensitive into other components to form a detergent composition, it may be advantageous to set certain operating parameters. For example, in some embodiments, the average shear rate utilized to incorporate the ESS may be from 300 $s^{-1}$ to 500 $s^{-1}$, from 100 $s^{-1}$ to 5000 $s^{-1}$, or from 0.01 $s^{-1}$ to 10000 $s^{-1}$. Instantaneous shear may be as high as from 3000 $s^{-1}$ to 5000 $s^{-1}$ for a short period of time. To define the rheology profile, a TA ARG2 Rheometer, available from TA Instruments, is used to determine the flow curve of the compositions. The determination is performed at 20° C. with a 4 cm flat plate measuring system set with a 500 micron gap. The determination is performed via programmed application of a shear rate continuous ramp (typically 0.05 $s^{-1}$ to 1000 $s^{-1}$) over a period of time (3 minutes). These data are used to create a viscosity versus shear rate flow curve.

The time needed to incorporate ESS into other components to form a detergent composition depends on whether continuous process or batch process is used. The time may be from 100 to 1000 seconds for batch process and for continuous process the time may be shorter from 0.01 to 10 seconds maximum.

Liquid Laundry Detergent Compositions

In some embodiments, the present invention is directed to liquid laundry detergent compositions comprising the ESS of the present invention. The liquid laundry detergent compositions may be in any suitable form and may comprise any suitable components. Non-limiting examples of suitable components are described in turn below.

Surfactant Component

The detergent compositions herein comprise from 1% to 70% by weight of a surfactant component selected from anionic, nonionic, cationic, zwitterionic and/or amphoteric surface active agents. More preferably, the surfactant component will comprise from 5% to 45% by weight of the composition and will comprise anionic surfactants, nonionic surfactants and combinations thereof.

Anionic Surfactants

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials. Preferred anionic surfactants for use herein have been described in WO 2011/0319940, pages 20-21.

Nonionic Surfactants

Suitable nonionic surfactants useful herein can comprise any of the conventional nonionic surfactant types typically used in liquid detergent products. These include alkoxylated fatty alcohols and amine oxide surfactants. Preferred for use in the liquid detergent products herein are those nonionic surfactants which are normally liquid. Preferred nonionic surfactants for use herein have been described in WO 2011/0319940, pages 21-22.

Anionic/Nonionic Surfactant Combinations

In the liquid detergent compositions herein, the detersive surfactant component may comprise combinations of anionic and nonionic surfactant materials.

Aqueous Liquid Carrier

Generally the amount of the aqueous, non-surface active liquid carrier employed in the compositions herein will be relatively large. For example, the non-aqueous, non-surface active liquid carrier component can comprise from 0% to 40% by weight of the compositions herein. More preferably this liquid carrier component will comprise from 1% to 30%, and even more preferably from 2% to 25% by weight of the compositions herein.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such alkanols, diols, other polyols, ethers, amines, and the like, have been conventionally been added to liquid detergent compositions as co-solvents or stabilizers, for purposes of the present invention, the utilization of such water-miscible liquids should be minimized to hold down composition cost. Accordingly, the aqueous liquid carrier component of the liquid detergent products herein will generally comprise water present in concentrations ranging from 0% to 90%, more preferably from 5% to 70%, by weight of the composition.

Optional Detergent Composition Ingredients

The detergent compositions of the present invention can also include any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from 2% to 50%, more preferably from 5% to 30%, by weight of the composition. A few of the optional ingredients which can be used have been described in greater detail in WO 2011/031940: organic detergent builders, pages 23-24; detersive enzymes, page 24; solvents, hydrotropes and phase stabilizers, page 24; and pH control agents, page 24.

Unit Dose Detergent

In some embodiments of the present invention, the liquid detergent compositions are packaged in a unit dose pouch, wherein the pouch is made of a water soluble film material, such as a polyvinyl alcohol. In some embodiments, the unit dose pouch comprises a single or multi-compartment pouch where the present liquid detergent composition can be used in conjunction with any other conventional powder or liquid detergent composition. Examples of suitable pouches and water soluble film materials are provided in U.S. Pat. Nos. 6,881,713, 6,815,410, and 7,125,828. Conventional processes for making of unit dose pouches are vertical form fill seal (VFFS) and horizontal form fill seal (HFFS), preferably HFFS with thermo and/or vacuum formin.

Hard Surface Cleaning Compositions

In some embodiments, the ESS may be utilized in liquid hard surface cleaning compositions. Such compositions include, but are not limited to, forms selected from gels, pastes, thickened liquid compositions as well as compositions having a water-like viscosity. A preferred liquid hard surface cleaning composition herein is an aqueous, liquid hard surface cleaning composition and therefore, preferably comprises water more preferably in an amount of from 50% to 98%, even more preferably of from 75% to 97% and most preferably 80% to 97% by weight of the total composition.

EXAMPLES

Referencing Tables I-III below, are non-limiting examples disclosed therein include those that are illustrative of several embodiments of the invention as well as those that are comparative.

TABLE I

ESS according to the present invention:

| Ingredient | Example A % | Example B % | Example C % | Example D % | Example E % | Example F (comparative) % |
|---|---|---|---|---|---|---|
| Softened water | 75.55 | 75.1 | 74.6 | 74.6 | 75.6 | 76.6 |
| MEA | 3.2 | 3.2 | 3.2 | 3.2 | 3.2 | 3.2 |
| HLAS (<20% 2-phenyl isomers) | 16 | — | — | 16 | 16 | 16 |
| HLAS (>20% 2-phenyl isomers) | — | 16 | 16 | — | — | — |
| HCO | 4 | 4 | 4 | 4 | 4 | 4 |
| 1,2 propanediol | 1.05 | — | 2 | 2 | — | — |
| Urea | — | — | — | — | 1 | — |
| Acticide | 0.2 | 0.2 | 0.2 | 0.2 | 0.2 | 0.2 |

TABLE II

Liquid Detergent Compositions comprising ESS according to the present invention Liquid Detergent Compositions

| Ingredient | Example 1% | Example 2% |
|---|---|---|
| Linear Alkylbenzene sulfonic acid[1] | 7.5 | 10.5 |
| C12-14 alkyl ethoxy 3 sulfate Na salt | 2.6 | |
| C12-14 alkyl ethoxy 3 sulfate MEA salt | | 8.5 |
| C12-14 alkyl 7-ethoxylate | 0.4 | 7.6 |
| C14-15 alkyl 7-ethoxylate | 4.4 | |
| C12-18 Fatty acid | 3.1 | 8 |
| Sodium Cumene sulfonate | 0.9 | |
| Citric acid | 3.2 | 2.8 |
| Ethoxysulfated Hexamethylene Diamine Dimethyl Quat | 1 | 2.1 |
| Soil Suspending Alkoxylated Polyalkylenimine Polymer[2] | 0.4 | |
| PEG-PVAc Polymer[3] | 0.5 | 0.8 |
| Di Ethylene Triamine Penta (Methylene Phosphonic acid, Na salt) | 0.3 | |
| Hydroxyethane diphosphonic acid | | 1.5 |
| Fluorescent Whitening Agent | 0.1 | 0.3 |
| 1,2 Propanediol | 3.9 | 7.5 |
| Diethylene Glycol | | 3.5 |
| Sodium Formate | 0.4 | 0.4 |
| Hydrogenated castor oil derivative structurant | 0.38 | 0.75 |
| Perfume | 0.9 | 1.7 |
| Sodium Hydroxide | To pH 8.4 | |
| Monoethanolamine | 0.3 | To pH 8.1 |

TABLE II-continued

Liquid Detergent Compositions comprising ESS according to the present invention Liquid Detergent Compositions

| Ingredient | Example 1% | Example 2% |
|---|---|---|
| Protease enzyme | 0.4 | 0.7 |
| Amylase enzyme | | 0.7 |
| Mannanase enzyme | 0.1 | 0.2 |
| Xyloglucanase enzyme | | 0.1 |
| Pectate lyase | 0.1 | |
| Water and minors (antifoam, aesthetics, . . . ) | To 100 parts | |

[1]Weight percentage of Linear Alkylbenzene sulfonic acid includes that which added to the composition via the premix
[2]600 g/mol molecular weight polyethylenimine core with 20 ethoxylate groups per -NH.
[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

TABLE III unit dose detergent compositions comprising ESS according to the present invention.

| Ingredient | Example 3% | Example 4% | Example 5% |
|---|---|---|---|
| Linear Alkylbenzene sulfonic acid[1] | 15 | 17 | 19 |
| C12-14 alkyl ethoxy 3 sulfonic acid | 7 | 8 | — |
| C12-15 alkyl ethoxy 2 sulfonic acid | — | — | 9 |
| C14-15 alkyl 7-ethoxylate | — | 14 | — |
| C12-14 alkyl 7-ethoxylate | 12 | — | — |
| C12-14 alkyl-9-ethoxylate | — | — | 15 |
| C12-18 Fatty acid | 15 | 17 | 5 |
| Citric acid | 0.7 | 0.5 | 0.8 |
| Polydimethylsilicone | — | 3 | — |
| Soil Suspending Alkoxylated Polyalkylenimine Polymer[2] | 4 | — | 7 |
| Hydroxyethane diphosphonic acid | 1.2 | | — |
| Diethylenetriamine Pentaacetic acid | — | — | 0.6 |
| Ethylenediaminediscuccinic acid | — | — | 0.6 |
| Fluorescent Whitening Agent | 0.2 | 0.4 | 0.2 |
| 1,2 Propanediol | 16 | 12 | 14 |
| Glycerol | 6 | 8 | 5 |
| Diethyleneglycol | — | — | 2 |
| Hydrogenated castor oil derivative structurant | 0.15 | 0.25 | 0.1 |
| Perfume | 2.0 | 1.5 | 1.7 |
| Perfume microcapsule | — | 0.5 | — |
| Monoethanolamine | Up to pH 8 | Up to pH 8 | Up to pH 8 |
| Protease enzyme | 0.05 | 0.075 | 0,12 |
| Amylase enzyme | 0.005 | — | 0.01 |
| Mannanase enzyme | 0.01 | | 0.005 |
| xyloglucanase | — | | 0.005 |
| Water and minors (antifoam, aesthetics, stabilizers etc.) | To 100 parts | To 100 parts | To 100 parts |

[1]Weight percentage of Linear Alkylbenzene sulfonic acid includes that which added to the composition via the premix
[2]600 g/mol molecular weight polyethylenimine core with 20 ethoxylate groups per -NH.

Comparative Data

The FIG. 1 relates to the viscosity of the Liquid Detergent as in example 1 using ESS as in example A, B, C and F.

The Liquid detergent composition was prepared in a 11 cm diameter plastic beaker, using a 10 cm diameter standard impellor, 4 45° pitched blades with a width of 2 cm. The clearance of the impellor with the bottom of the beaker was 2 cm. The ESS was added as last ingredient at an impellor speedo of 300 RPM. When all the ESS was added the Liquid Detergent was mixed for another 60 seconds at 300 RPM.

The viscosity of the samples in FIG. 1 were measured 1 day after production on a TA instruments ARG2 rotational rheometer using a 40 mm 1° cone and plate geometry. The rheometer procedure applied comprised steps of 1. Bringing the sample to 20° C.
2. Executing a pre-shear at shear rate 10/s for 10 seconds
3. Execution an equilibration step for 60 seconds at 20° C.
4. Execution of a shear rate peak hold step at shear rate 0.05/s.

The maximum viscosity read during the peak hold step is reported.

FIG. 1 illustrates that the ESS examples according to present invention deliver higher low shear viscosity than the reference ESS to the Liquid Detergent. This demonstrates that the ESS according to present invention have more effective structuring properties using the same quantity of crystallizable glycerides.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Process of preparing an external structuring system for liquid and gel-form detergents comprising steps of:

i) preparing a premix by adding about 5% to about 50% by weight of the external structuring system of anionic surfactant into water and mixing;

ii) neutralising premix of step i) to pH 7.0-7.6 by adding pH adjusting agent at temperature between about 87° C. and about 95° C. and mixing;

iii) adding about 2% to about 10% by weight of the external structuring system of crystals of a glyceride having melting point of from about 40° C. to about 100° C. and mixing;

iv) emulsification by mixing of the premixture of steps i)-iii);

v) cooling the emulsification of step iv) down to a temperature between about 25° C. and about 45° C. under controlled cooling rate of about 1 to about 2° C./min;

characterized in that from about 0.5% to about 3.0% by weight of the external structuring system of packing parameter adjusting agent is added into said premix prior to the point where said crystals of a glyceride start to crystallize.

2. The process according to claim 1, wherein said crystals of glyceride are hydrogenated castor oil.

3. The process according to claim 1, wherein said pH adjusting agent is selected from group consisting of monoethanolamine, diethanolamine, triethanolamine, sodiumhydroxide, and mixtures thereof.

4. The process according to claim 3, wherein said pH adjusting agent is monoethanolamine.

5. The process according to claim 1, wherein said pH adjusting agent is used at level from about 2% to about 10% by weight of the external structuring system.

6. The process according to claim 1, wherein said anionic surfactant is a synthetic anionic surfactant selected from the group consisting of sodium linear alkylbenzene sulfonates, potassium linear alkylbenzene sulfonates, and acidic form of linear alkylbenzene sulfonates (HLAS), in which the average number of carbon atoms in the alkyl group is from 11 to 14.

7. The process according to claim 1, wherein said anionic surfactant is acid form of linear alkylbenzenesulfonate (HLAS) in which the average number of carbon atoms in the alkyl group is from 11 to 14, and wherein HLAS comprises at least about 20% by weight of HLAS of 2-phenyl isomer.

8. The process according to claim 1, wherein said packing parameter adjusting agent is selected from the group consisting of ethanol, propanol, butanol, isopropanol, 1,2-propanediol, 1,3-propanediol, diethylglycol, urea, and mixtures thereof.

9. The process according to claim 8, wherein the packing parameter adjusting agent is 1,2-propanediol, 1,3-propanediol, or mixtures thereof.

10. The process according to claim 9, wherein the packing parameter adjusting agent is 1,2-propanediol.

11. The process according to claim 1, wherein said packing parameter adjusting agent is added at the latest when the temperature of the premix is above about 75° C.

12. A detergent composition comprising the external structuring system produced by the process according to claim 1.

13. The detergent composition of claim 12, wherein said detergent composition is in a form selected from liquid and gel.

14. The detergent composition of claim 12, wherein said detergent is a liquid laundry detergent comprising from about 1% to about 20% external structuring system by weight of the liquid laundry detergent composition, and wherein said external structuring system provides sufficient hydrogenated castor oil to achieve a finished detergent product level of from about 0.1 to about 10 by weight % of the finished detergent product of hydrogenated castor oil.

15. The laundry detergent composition of claim 12, wherein said detergent composition is a liquid enclosed in water-soluble film.

16. The detergent composition of claim 12, wherein said detergent is a detergent selected from a hard surface cleaning composition and a liquid laundry detergent composition.

* * * * *